US007688054B2

(12) United States Patent
Cave

(10) Patent No.: US 7,688,054 B2
(45) Date of Patent: Mar. 30, 2010

(54) BANDGAP CIRCUIT WITH TEMPERATURE CORRECTION

(76) Inventor: David Cave, 2162 E. La Vieve, Tempe, AZ (US) 65284

( * ) Notice: Subject to any disclaimer, the term of this patent is extended or adjusted under 35 U.S.C. 154(b) by 277 days.

(21) Appl. No.: 11/446,036

(22) Filed: Jun. 2, 2006

(65) Prior Publication Data

US 2007/0279029 A1 Dec. 6, 2007

(51) Int. Cl.
*G05F 3/30* (2006.01)

(52) U.S. Cl. ..... 323/313; 323/316; 323/907

(58) Field of Classification Search ..... 323/313, 323/316, 907, 314, 317, 315; 327/539
See application file for complete search history.

(56) References Cited

U.S. PATENT DOCUMENTS 5,229,710 A * 7/1993 Kraus et al. ..... 323/313
5,712,590 A * 1/1998 Dries et al. ..... 327/539
6,157,245 A * 12/2000 Rincon-Mora ..... 327/539
6,218,822 B1 * 4/2001 MacQuigg ..... 323/313
6,225,850 B1 * 5/2001 Opris ..... 327/356
6,642,699 B1 * 11/2003 Gregoire, Jr. ..... 323/314
6,677,808 B1 * 1/2004 Sean et al. ..... 327/539
6,724,176 B1 * 4/2004 Wong et al. ..... 323/316
7,224,209 B2 * 5/2007 Hsu ..... 327/538

* cited by examiner

*Primary Examiner*—Harry Behm
(74) *Attorney, Agent, or Firm*—Knobbe, Martens, Olson & Bear LLP

(57) ABSTRACT

A temperature corrected voltage bandgap circuit is provided. The circuit includes first and second diode connected transistors. A first switched current source is coupled to the one transistor to inject or remove a first current into or from the emitter of that transistor. The first current is selected to correct for curvature in the output voltage of the bandgap circuit at one of hotter or colder temperatures.

27 Claims, 8 Drawing Sheets

BANDGAP CIRCUIT WITH TEMPERATURE CORRECTION

FIELD OF THE INVENTION

The present invention pertains to temperature sensing, in general, and to an improved bandgap circuit, in particular.

BACKGROUND OF THE INVENTION

To measure temperature, a common method utilizes a sensor to convert the quantity to be measured to a voltage. Common solid state sensors utilize semiconductor diode Vbe, the difference in Vbe at two current densities or delta Vbe, or a MOS threshold to provide a temperature dependent output voltage. The temperature is determined from the voltage measurement. Once the sensor output is converted to a voltage it is compared it to a voltage reference. It is common to utilize a voltage reference having a low temperature coefficient such as a bandgap circuit as the voltage reference. The bandgap voltage reference is about 1.2 volts. An n-bit analog to digital converter divides the bandgap reference down by $2^n$ and determines how many of these small pieces are needed to sum up to the converted voltage. The precision of the A/D output is no better than the precision of the bandgap reference.

Typical plots of the output bandgap voltage with respect to temperature are bowed and are therefore of reduced accuracy.

Prior bandgap voltage curvature correction solutions result in very complicated circuits whose performance is questionable.

SUMMARY OF THE INVENTION

In accordance with the principles of the invention, a temperature corrected bandgap circuit is provided which provides a significantly flatter response of the bandgap voltage with respect to temperature.

In accordance with the principles of the invention, a temperature corrected voltage bandgap circuit is provided. The circuit includes first and second diode connected transistors with the area of one transistor being selected to be a predetermined multiple of the area of the other transistor. A first switchable current source is coupled to the one transistor to inject a first current into the emitter of that transistor when its base-emitter voltage is at a first predetermined level. The first current is selected to correct for curvature in the output voltage of the bandgap circuit at one of hotter or colder temperatures.

Further in accordance with the principles of the invention a second current source is coupled to the other transistor to remove a second current from the other transistor emitter. The second current is selected to correct for curvature in the output voltage at the other of said hotter or colder temperatures. The current removal of the second current source is initiated when the base-emitter voltage of the other transistor reaches a predetermined level.

The bandgap circuit, the first current source and the second current source are formed on a single substrate.

BRIEF DESCRIPTION OF THE DRAWING

The invention will be better understood from a reading of the following detailed description in conjunction with the drawing figures in which like reference designators identify like elements, and in which.

DETAILED DESCRIPTION

For a bipolar transistor the first order equation for collector current related to Vbe is:

$$I_c = AI_s(e^{(Vbe \cdot q)/kT} - 1)$$

where:

T is temperature in Kelvin;

A is an area scale;

$I_s$ is dark current for a unit area device (process dependent);

q is charge on the electron; and

K is Boltzman's constant.

In the forward direction, even at very low bias, the $(e^{(Vbe \cdot q)/kT})$ term over-powers the −1 term. Therefore in the forward direction:

$$I_c = I_s(e^{(Vbe \cdot q)/kT})$$

and $$V_{be} = (kT/q) \cdot \ln(I_c/AI_s)$$

Two junctions operating at different current densities will have a different Vbe related by the natural logs of their current densities.

From this it can be shown that the slope of Vbe vs. temperature must depend on current density. Vbe has a negative temperature coefficient. However, the difference in Vbe, called the ΔVbe, has a positive temperature coefficient.

$$\Delta Vbe = Vbe|_1 - Vbe|_A = (kT/q) \cdot [\ln(I_1/I_S) - \ln(I_2/AI_S)]$$

For $I_1 = I_2$ and an area scale of A $$\Delta Vbe = (kT/q) \ln A$$

In the illustrative embodiment of the invention, a bandgap circuit is formed as part of a CMOS device of the type utilizing CMOS N-well process technology.

Figure 1:
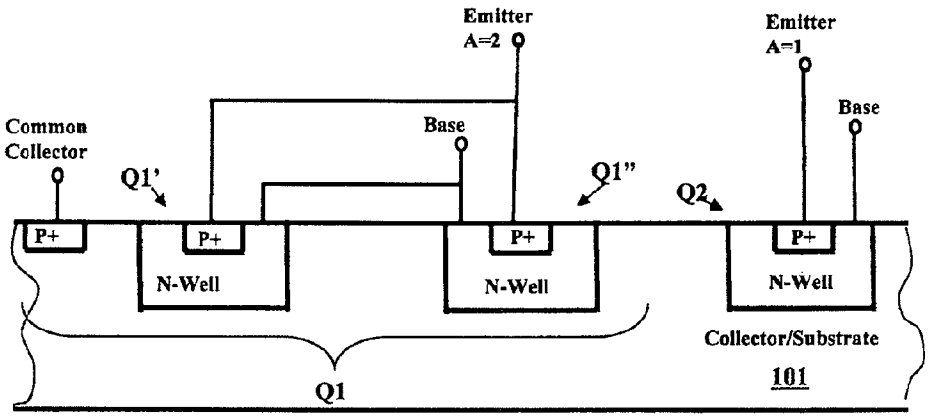
FIG. 1 PRIOR ART
FIG. 1 illustrates a prior art CMOS N-well substrate having a bipolar transistor structure of a type that may be utilized in a bandgap circuit.
Figure 2:
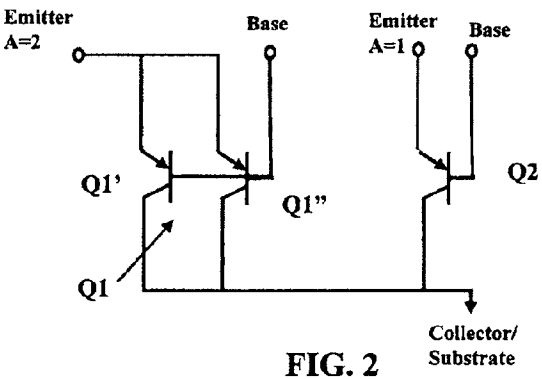
FIG. 2 PRIOR ART
FIG. 2 is a schematic of the prior art bipolar structure of FIG. 1.

The most usable bipolar transistors available in the CMOS N-well process is the substrate PNP as shown in FIG. 1 in which a single transistor Q1 is formed by transistors Q1', Q1" which has an area ratio, A, that is twice that of the transistor Q2. The structure is shown in schematic form in FIG. 2. All the collectors of transistors Q1', Q1", Q2 are connected to the chip substrate 101, i.e., ground. There is direct electrical access to the base and emitter of each transistor Q1', Q1", Q2 to measure or control Vbe but there is no separate access to the collectors of the transistors Q1', Q1", Q2 to monitor or control collector current.

There are several general topologies based on the standard CMOS process and its substrate PNP that can be used to create a bandgap circuit.

Figure 3:
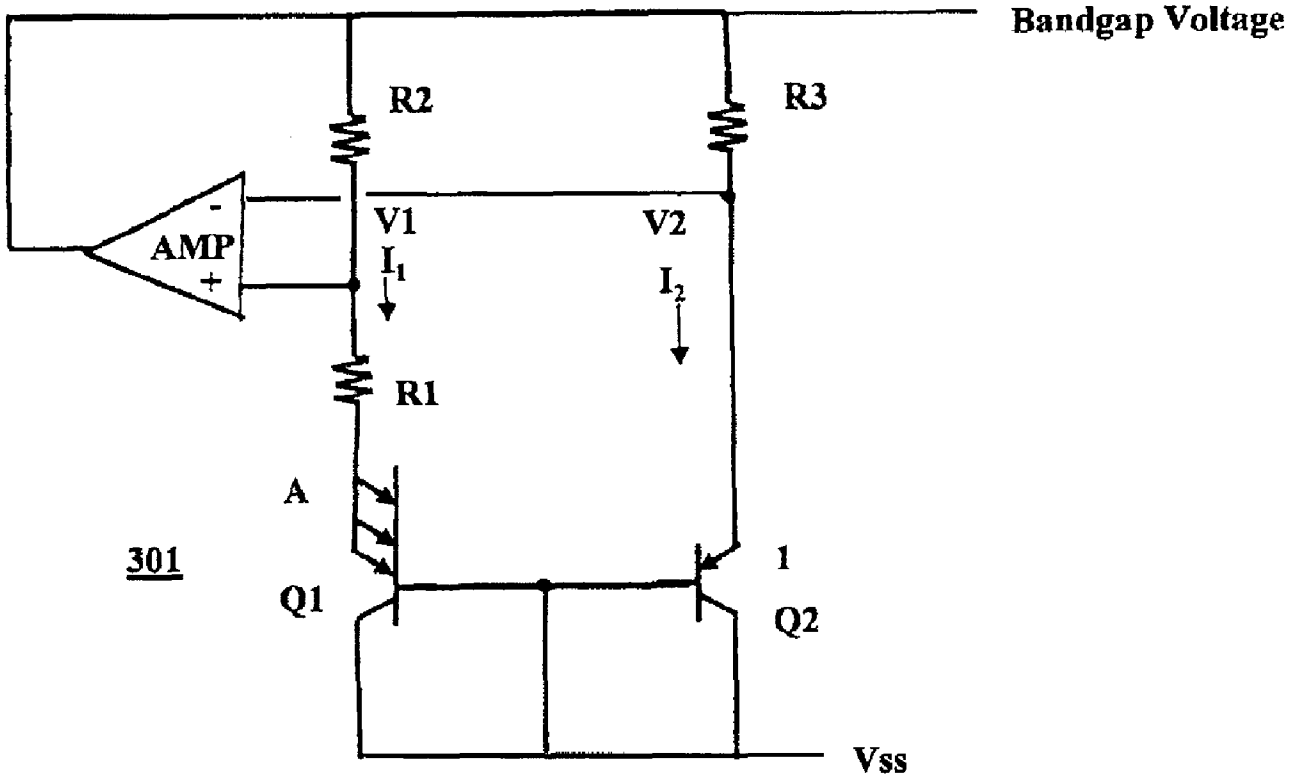
FIG. 3 PRIOR ART
FIG. 3 is a schematic of a prior art bandgap circuit.

FIG. 3 illustrates a prior art bandgap circuit 301 architecture. Bandgap circuit 301 comprises transistor Q1 and transistor Q2. The area of transistor Q1 is selected to be a predetermined multiple A of the area of transistor Q2. First and second serially connected resistors R1, R2 are connected between an output node Vbandgap and the emitter of transistor Q2. A third resistor is connected in series between output node Vref and the emitter of transistor Q1. A differential input amplifier AMP has a first input coupled to a first circuit node disposed between resistors R1, R2; and a second input coupled to a second node disposed between resistor R3 and the emitter of transistor Q1. Amplifier AMP has its output coupled to the output node bandgap.

Bandgap voltage and slope with respect to temperature or temperature coefficient, TC, are sensitive to certain process and design variables.

With the foregoing in mind, considering all the variables, and making specific assumptions, a closed form for the bandgap voltage is:

$$V\text{bandgap}=(kT/q)\cdot\{\ln[((kT/q)\cdot\ln A/R_t)/I_s]\}+(1+R_2/R_1)(kT/q)\cdot\ln A$$

This is of the form Vref=Vbe+mΔVbe

When m is correctly set, the temperature coefficient of Vref will be near zero. The resulting value of Vref will be near the bandgap voltage of silicon at 0° K., thus the name "bandgap circuit."

Figure 4:
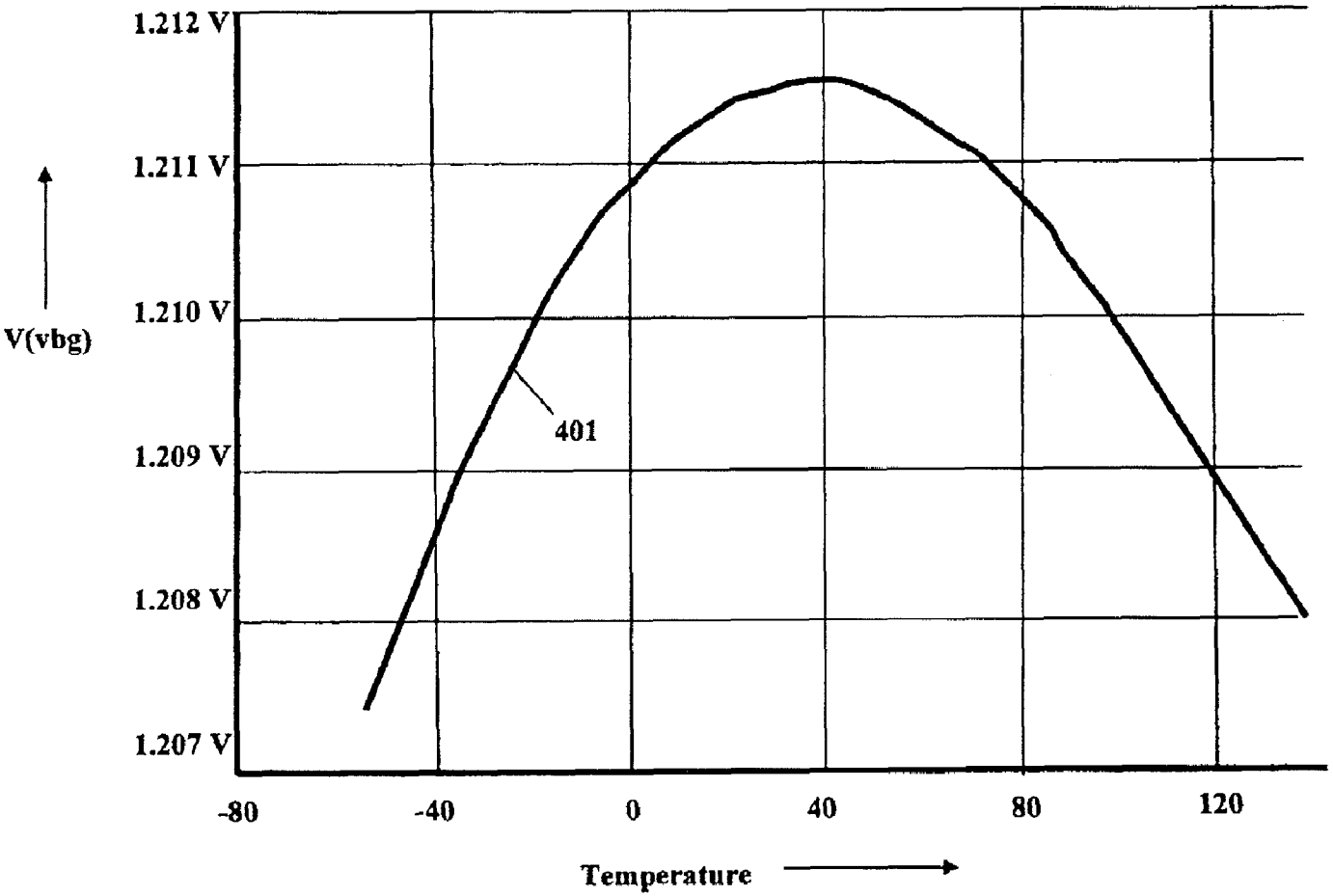
FIG. 4 PRIOR ART
FIG. 4 is a typical plot of bandgap circuit voltage versus temperature for the prior art circuit of FIG. 4.

However, Vbe for a bipolar transistor operating at constant current has a slight bow over temperature. The net result is that a plot of bandgap voltage Vref against temperature has a bow as shown by curve 401 in FIG. 4.

Figure 5:
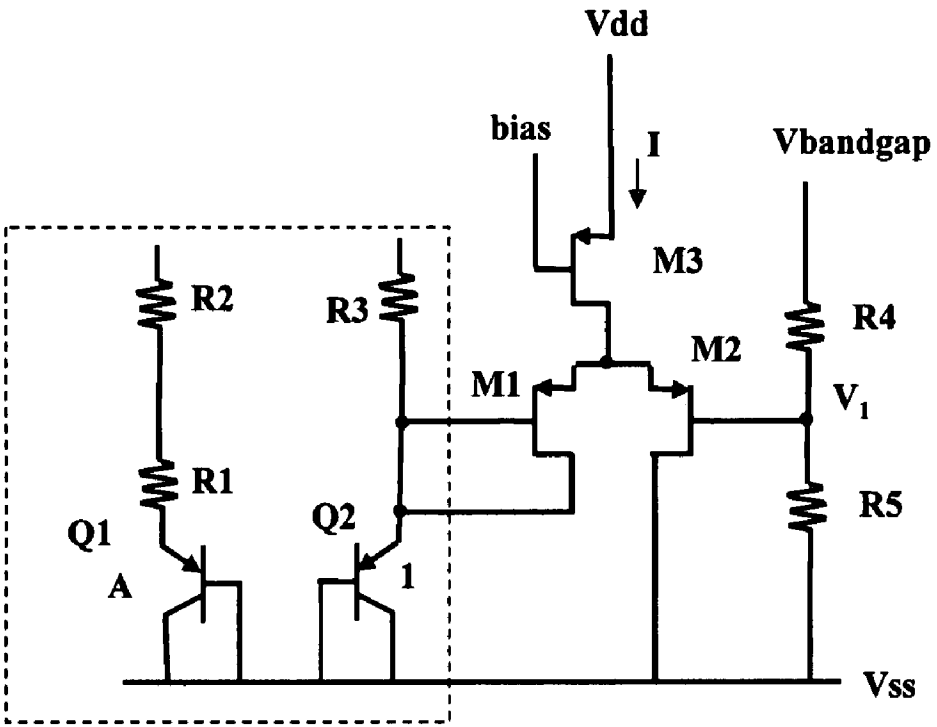
FIG. 5 is a schematic of a circuit in accordance with the principles of the invention.

In accordance with one aspect of the invention, a simple differential amplifier formed by transistors M1, M2 as shown in FIG. 5 is used and a comparison is made between a near zero temperature coefficient voltage from the bandgap to the negative temperature coefficient of the bandgap Vbe. By providing proper scaling to add or subtract a controlled current to the bandgap at hot and cold temperatures the bandgap curve is flattened.

FIG. 5 illustrates a portion of a simplified curvature corrected bandgap circuit in accordance with the principles of the invention.

Transistor M1 and transistor M2 compare the nearly zero temperature coefficient, TC, voltage V1 (derived from the bandgap) to the Vbe voltage of the unit size bipolar transistor Q2 in the bandgap. By adjusting the value of V1 the threshold temperature where the differential pair M1, M2 begins to switch and steer current provided by transistor M3 into the bandgap is moved. Voltage V1 is selected to begin adding current at the temperature where the bandgap begins to dip, e.g., 40° C. The width/length W/L ratio of transistors M1, M2 will define the amount of differential voltage necessary to switch all of the current from transistor M2 to transistor M1. The current I sets the maximum amount of current that can or will be added to the bandgap.

In accordance with the principles of the invention, by utilizing 3 transistors and 2 resistors the correction threshold, rate (vs. temperature) and amount of curvature (current) correction on the high temperature side can be corrected. The effect of this current injection is shown by curve 601 in FIG. 6

Figure 7:
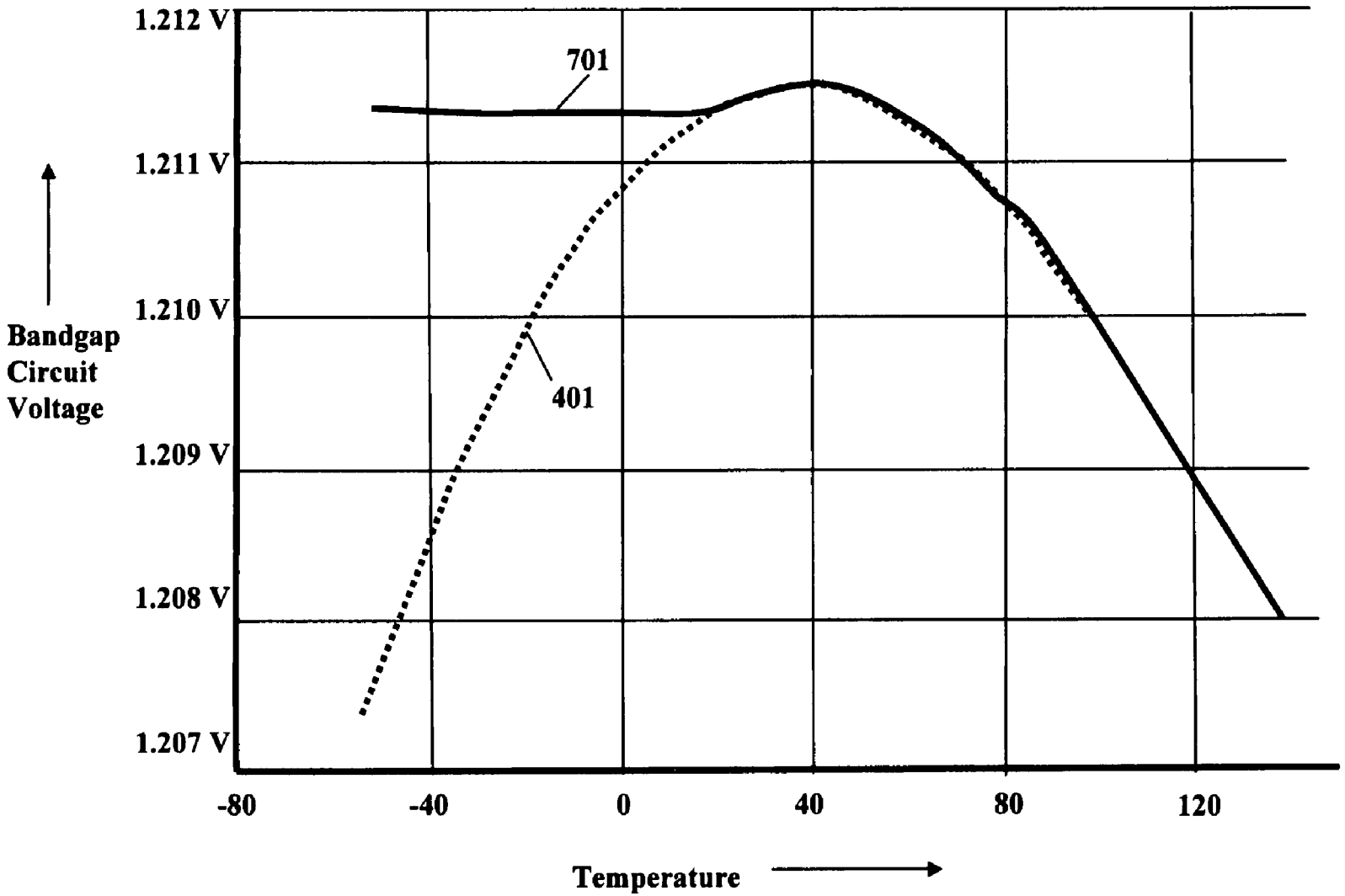
FIG. 7 is a plot of bandgap circuit voltage versus temperature with low temperature compensation in accordance with the principles of the invention.

The comparator/current injection structure can be mirrored for curvature correction of the cold temperature side of the bandgap by providing current removal from the larger or A sized transistor Q1 of the bandgap circuit. The effect of such curvature correction on the cold side is shown by curve 701 in FIG. 7.

Figure 9:
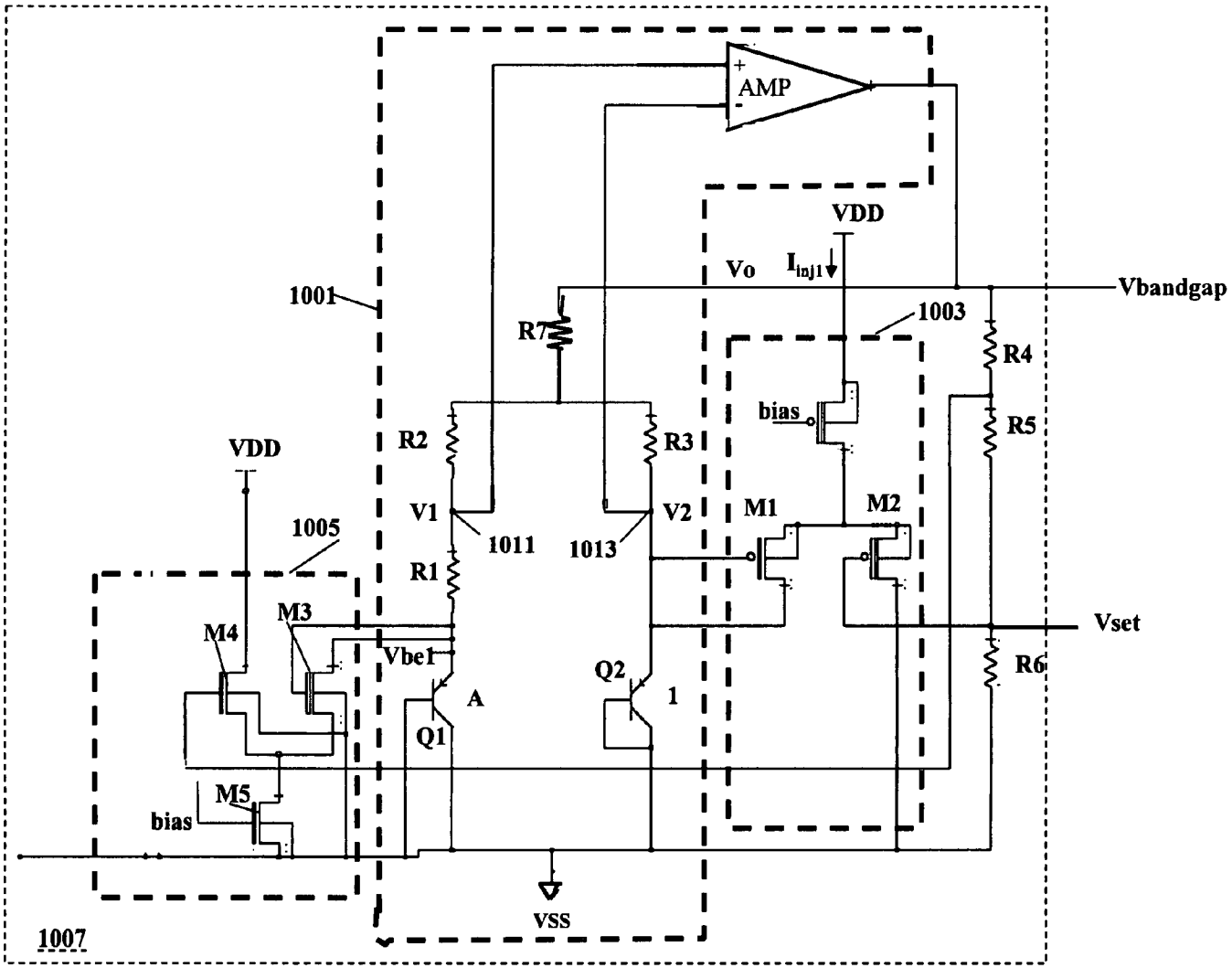
FIG. 9 is a schematic of a bandgap circuit in accordance with the principles of the invention.

A fully compensated bandgap circuit in accordance with the principles of the invention that provides both hot and cold temperature compensation is shown in FIG. 9.

Figure 8:
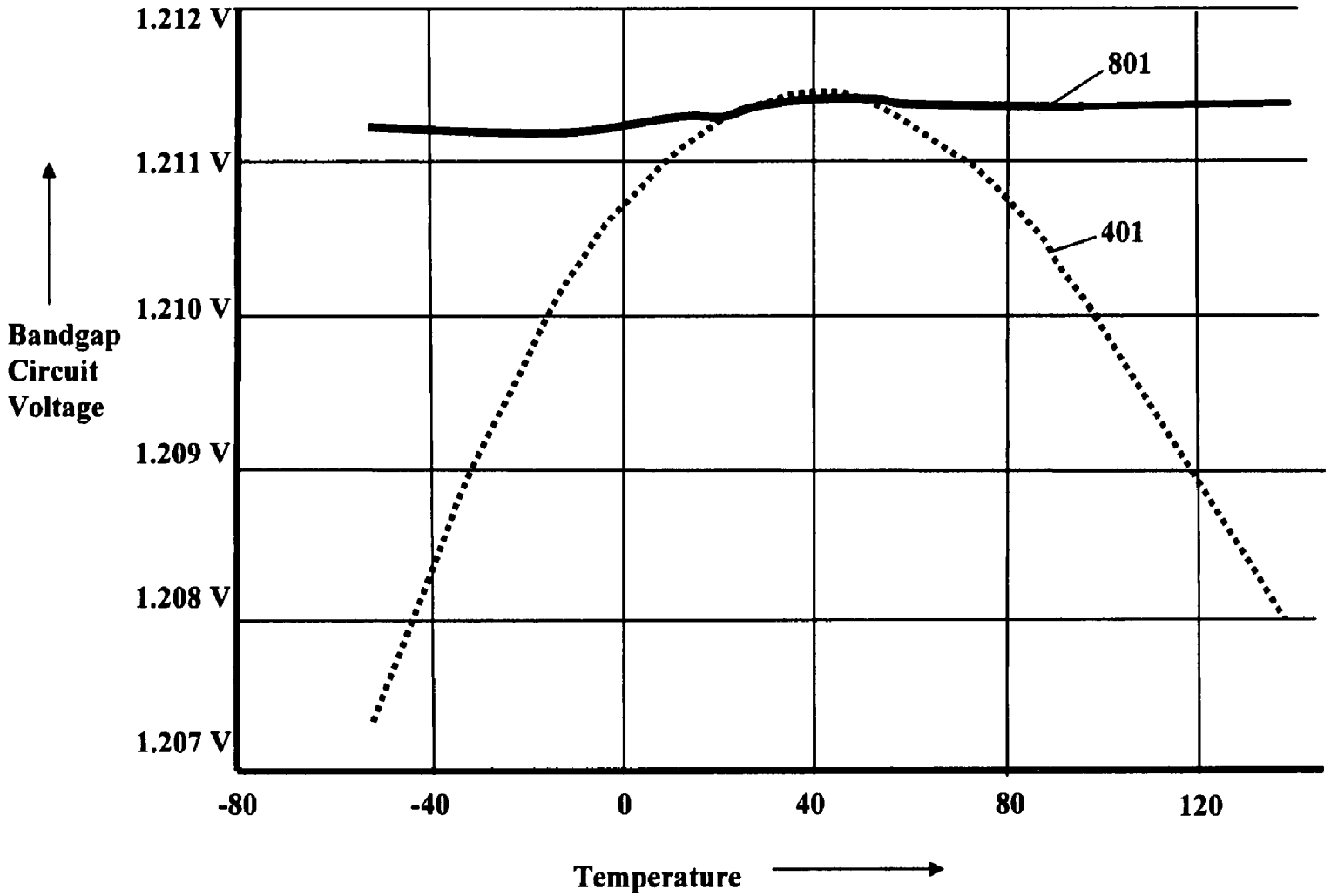
FIG. 8 is a plot of bandgap circuit voltage versus temperature with high and low temperature compensation in accordance with the principles of the invention.

The circuit of FIG. 9 shows substantial improvement in performance over a temperature range of interest is −40 to 125° C. A plot of Vref versus temperature is shown in FIG. 8 as curve 801.

The compensated circuit of FIG. 9 includes bandgap circuit 1001, current injection circuit 1003 and current injection circuit 1005.

Bandgap circuit 1001 comprising a transistor Q2 and a transistor Q1. The area of transistor Q1 is selected to be a predetermined multiple A of the area of transistor Q2. First and second serially connected resistors R1, R2 are connected between an output node Vbandgap and the emitter of transistor Q2. A third resistor is connected in series between output node Vref and the emitter of transistor Q1. A differential input amplifier AMP has a first input coupled to a first circuit node disposed between resistors R1, R2; and a second input coupled to a second node disposed between resistor R3 and the emitter of transistor Q1. Amplifier AMP has its output coupled to the output node Vbandgap.

A first switchable current source 1003 is coupled to said transistor Q2 to inject a first current into the emitter of transistor Q2. The current $I_{inj1}$ is selected to correct for one of hotter or colder temperatures, more specifically, in the illustrative embodiment, the current $I_{inj1}$ is injected at higher temperatures when the base emitter voltage across transistor Q2 to a first predetermined voltage Vset. The voltage Vset is determined by a resistance network formed by resistors R4, R5, R6.

A second switchable current source 1005 is coupled to transistor Q1 to remove a second current $I_{inj2}$ into the emitter of transistor Q1. The second current $I_{inj2}$ is selected to correct for the other of the hotter or colder temperatures, and more specifically for colder temperatures.

Bandgap circuit 1001, and switchable current injection circuits 1003, 1005 are formed on a single common substrate 1007.

The resistors R4, R5, and R6 are trimmable resistors and are utilized to select the voltages at which the current sources inject current from switchable current injection circuits 1003, 1005 into bandgap circuit 1001.

The invention has been described in terms of illustrative embodiments. It is not intended that the scope of the invention be limited in any way to the specific embodiments shown and described. It is intended that the invention be limited in scope only by the claims appended hereto, giving such claims the broadest interpretation and scope that they are entitled to under the law. It will be apparent to those skilled in the art that various changes and modifications can be made without departing from the spirit or scope of the invention. It is intended that all such changes and modifications are encompassed in the invention as claimed.

What is claimed is:

1. A bandgap circuit, comprising:

a diode-connected first transistor and a diode-connected second transistor, wherein the first and second transistors each have a plurality of terminals and are connected in a bandgap circuit; and a first switchable current source including a third transistor having a plurality of terminals, wherein at least two of the plurality of terminals are connected to the second transistor, and wherein the first switchable current source is configured to inject a first predetermined current into the second transistor when a voltage between two of the second transistor terminals has a predetermined relationship to a first voltage, whereby a first temperature compensation is provided to the bandgap circuit.

2. The bandgap circuit of claim 1, wherein one of the first or second transistors has an area that is a multiple, A, times the area of the other of the first or second transistors.

3. The bandgap circuit of claim 1, further comprising a single substrate including the first and second transistors, wherein the first switchable current source is formed on the substrate.

4. The bandgap circuit of claim 3, wherein both the first and second transistors are bipolar transistors.

5. The bandgap circuit of claim 4, wherein the first switchable current source comprises MOS transistors.

6. The bandgap circuit of claim 3, wherein the substrate is of a type utilizing CMOS N-well process technology.

7. The bandgap circuit of claim 6, wherein both the first and second transistors comprise a substrate PNP transistor.

8. The bandgap circuit of claim 7, wherein the first switchable current source comprises CMOS transistors.

9. The bandgap circuit of claim 1, further comprising a second switchable current source coupled to the first transistor and configured to remove a second predetermined current from the first transistor when the voltage between two of the first transistor terminals has a predetermined relationship to a second voltage, whereby a second temperature compensation is provided to the bandgap circuit.

10. The bandgap circuit of claim 9, wherein:

one of the first or second transistors has an area that is a multiple, A, times the area of the other of the first or second transistors;

the first temperature compensation compensates for effects of temperatures above a first predetermined temperature of the substrate; and the second temperature compensation compensates for effects of temperatures below a second predetermined temperature of the substrate.

11. The bandgap circuit of claim 9, further comprising a single substrate including the first and second transistors, wherein the first and second switchable current sources are formed on the substrate.

12. The bandgap circuit of claim 11, wherein both the first and second transistors are bipolar transistors.

13. The bandgap circuit of claim 12, wherein both the first and second switchable current sources comprise MOS transistors.

14. The bandgap circuit of claim 11, wherein the substrate is of a type utilizing CMOS N-well process technology.

15. The bandgap circuit of claim 14, wherein both the first and second transistors comprise a substrate PNP transistor.

16. The bandgap circuit of claim 15, wherein both the first and second switchable current sources comprise CMOS transistors.

17. A temperature corrected bandgap circuit, comprising:

a first transistor and a second transistor, wherein the area of the first transistor is selected to be a predetermined multiple of the area of the second transistor;

first and second serially-connected resistors connected between an output node and the emitter of the first transistor;

a first node disposed between the first and second serially-connected resistors;

a third resistor connected in series between the output node and the emitter of the second transistor;

a second node disposed between the third resistor and the second transistor emitter;

a third node disposed between the emitter of the first transistor and the first and second serially-connected resistors;

a differential input amplifier having a first input coupled to the first node and a second input coupled to the second node, wherein the amplifier has its output coupled to the output node; and a first switched current source including a first voltage responsive switch comprising a third transistor having a plurality of terminals, wherein at least two of the plurality of terminals are coupled to the third node, wherein the first voltage responsive switch is configured to inject or remove a first current into or from the first transistor when an output voltage at the output node is at a first predetermined level, and wherein the first current is selected to provide temperature correction in the output voltage for one of hotter or colder temperatures.

18. The bandgap circuit of claim 17, further comprising a second switched current source including a second voltage responsive switch coupled to the second transistor and configured to remove or inject a second current from or into the second transistor when the output voltage at the output node is at a second predetermined level, wherein the second current is selected to provide temperature correction in the output voltage for the other of the hotter or colder temperatures.

19. The bandgap circuit of claim 18, wherein both the first and second transistors are bipolar transistors.

20. The bandgap circuit of claim 19, wherein both the first and second switched current sources and comprise MOS transistors.

21. The bandgap circuit of claim 20, wherein:

the bandgap circuit is formed on a single substrate; and the substrate is of a type utilizing CMOS N-well process technology.

22. The bandgap circuit of claim 17, wherein the first and second transistors are bipolar transistors.

23. The bandgap circuit of claim 22, wherein the first switched current source comprises MOS transistors.

24. The bandgap circuit of claim 23, wherein:

the bandgap circuit is formed on a single substrate; and the substrate is of a type utilizing CMOS N-well process technology.

25. The bandgap circuit of claim 17, wherein the first voltage responsive switch comprises only three transistors.

26. A bandgap circuit, comprising:

a diode-connected first transistor and a diode-connected second transistor, wherein the first and second transistors each have a plurality of terminals and are connected in a bandgap circuit; and a first switchable current source including a third transistor having a plurality of terminals, wherein at least two of the plurality of terminals are coupled to the second transistor, and wherein the first switchable current source is configured to remove a first predetermined current from the second transistor when a voltage between two of the second transistor terminals has a predetermined relationship to a first voltage, whereby a first temperature compensation is provided to the bandgap circuit.

27. A bandgap circuit, comprising:

a diode-connected first transistor and a diode-connected second transistor, wherein the first and second transistors each have a plurality of terminals and are connected in a bandgap circuit;

a first switchable current source including a third transistor having a plurality of terminals, wherein at least two of the plurality of terminals are coupled to the second transistor, and wherein the first switchable current source is configured to inject a first predetermined current into the second transistor when a voltage between two of the second transistor terminals has a predetermined relationship to a first voltage, whereby a first temperature compensation is provided to the bandgap circuit; and a second switchable current source coupled to the first transistor and configured to remove a second predetermined current from the first transistor when the voltage between two of the first transistor terminals has a predetermined relationship to a second voltage, whereby a second temperature compensation is provided to the bandgap circuit.

* * * * *

UNITED STATES PATENT AND TRADEMARK OFFICE

CERTIFICATE OF CORRECTION

PATENT NO. : 7,688,054 B2
APPLICATION NO. : 11/446036
DATED : March 30, 2010
INVENTOR(S) : David Cave It is certified that error appears in the above-identified patent and that said Letters Patent is hereby corrected as shown below:

On the Title page, Item 76 (Inventor), please delete "65284" and insert --85284--, therefor.

In Column 2, Line 36 (approx..), please delete "Boltzman's" and insert --Boltzmann's--, therefor.

In Column 3, Line 28 (approx..), please delete "$A/R_t$" and insert --$A/R_1$--, therefor.

Figure 6:
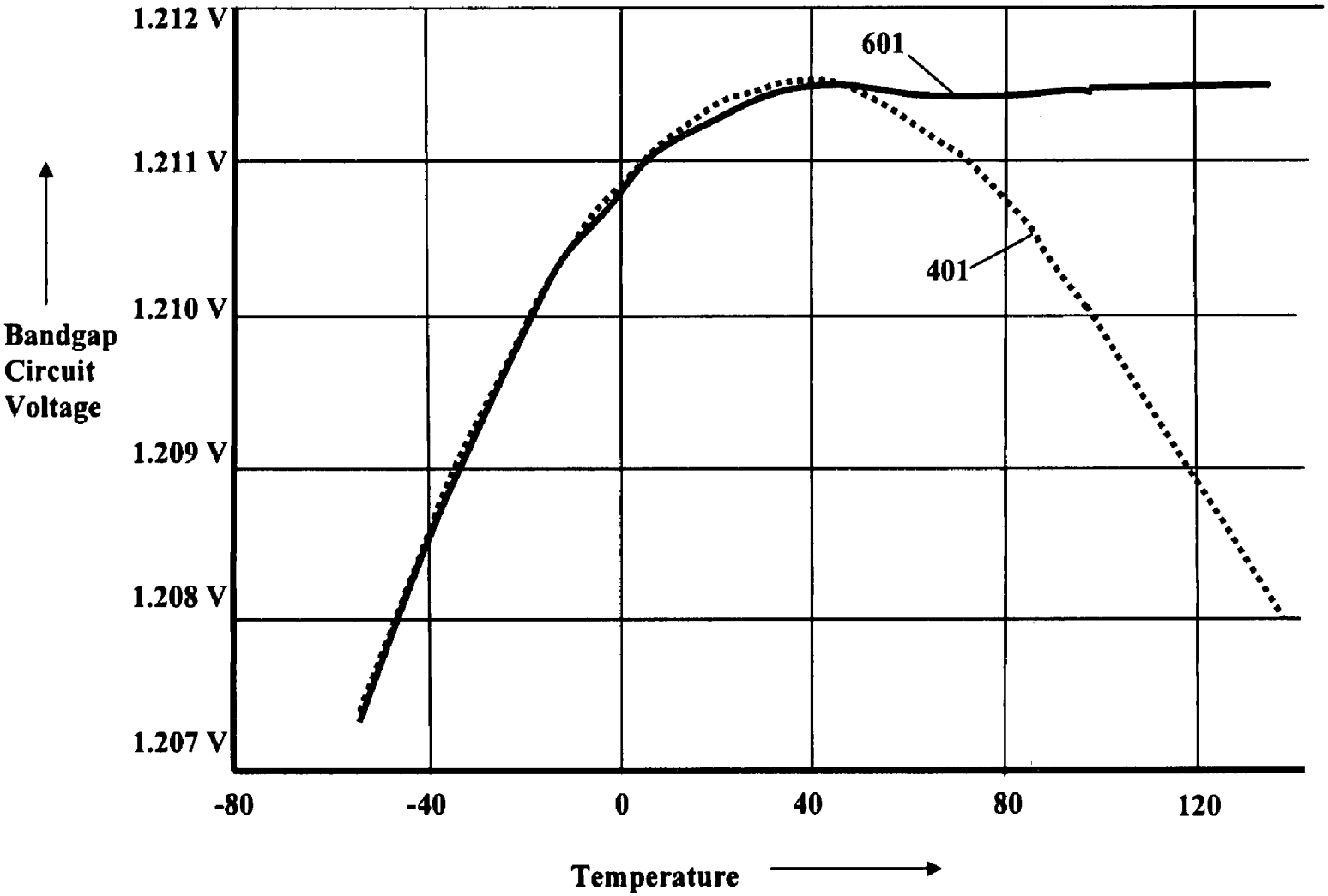
FIG. 6 is a plot of bandgap circuit voltage versus temperature with high temperature compensation in accordance with the principles of the invention.

In Column 4, Line 2-3, after "FIG. 6", please insert --.--.

In Column 6, Line 42, in Claim 20, after "sources", please delete "and".

Signed and Sealed this

Sixteenth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,688,054 B2
APPLICATION NO. : 11/446036
DATED : March 30, 2010
INVENTOR(S) : David Cave It is certified that error appears in the above-identified patent and that said Letters Patent is hereby corrected as shown below:

In the Specification

Column 3, at line 14, Change “Q2” to --Q1--.

Column 3, at line 15, Change “Vref” to --Vbandgap--.

Column 3, at line 15, Change “Q1” to --Q2--.

Column 3, at line 19, Change “Q1” to --Q2--.

Column 3, at line 20, Change “bandgap” to --Vbandgap--.

Column 4, at line 27, Change “Q2” to --Q1--.

Column 4, at line 28, Change “Vref” to --Vbandgap--.

Column 4, at line 28, Change “Q1” to --Q2--.

Column 4, at line 32, Change “Q1” to --Q2--.

Column 4, at line 41, Change “to” to --is--.

Signed and Sealed this
Thirteenth Day of August, 2013

Teresa Stanek Rea
*Acting Director of the United States Patent and Trademark Office*